United States Patent [19]

Mills et al.

[11] Patent Number: 4,899,570

[45] Date of Patent: Feb. 13, 1990

[54] APPARATUS AND METHOD OF ROTARY FORGING WITH INDUCTION HEATING

[75] Inventors: Gary L. Mills, Monroe; B. Dean Bowen, Matthews, both of N.C.

[73] Assignee: Teledyne Industries, Inc., Monroe, N.C.

[21] Appl. No.: 177,783

[22] Filed: Apr. 5, 1988

[51] Int. Cl.[4] ..... B21J 1/06

[52] U.S. Cl. ..... 72/364; 72/69; 72/402

[58] Field of Search ..... 72/69, 76, 342, 364, 72/402, 403

[56] References Cited

U.S. PATENT DOCUMENTS

| | | | |
|---|---|---|---|
| 2,464,658 | 3/1949 | Stivin | 72/342 |
| 2,618,734 | 11/1952 | Anderson . | |
| 2,988,623 | 6/1961 | Ross et al. . | |
| 3,059,510 | 10/1962 | Appel | 72/402 |
| 3,068,336 | 12/1962 | Tamm . | |
| 3,610,315 | 10/1971 | Juergens et al. . | |
| 3,622,407 | 11/1971 | Niculescu et al. . | |
| 3,662,995 | 5/1972 | Armstrong . | |
| 3,715,556 | 2/1973 | Balzer et al. . | |
| 3,717,740 | 2/1973 | Vickers . | |
| 3,842,235 | 10/1974 | Opprecht . | |
| 3,893,321 | 7/1975 | Braunwieser | 72/76 |
| 4,362,578 | 12/1982 | Mills et al. . | |
| 4,407,486 | 10/1983 | Mills et al. . | |
| 4,523,445 | 6/1985 | Yoshida | 72/69 |

FOREIGN PATENT DOCUMENTS

| | | | |
|---|---|---|---|
| 582338 | 9/1959 | Canada | 72/342 |
| 427910 | 11/1948 | Italy | 72/403 |
| 199517 | 12/1982 | Japan | 72/342 |
| 286034 | 12/1986 | Japan | 72/69 |
| 937431 | 9/1963 | United Kingdom | 72/402 |

*Primary Examiner*—Lowell A. Larson

*Attorney, Agent, or Firm*—Bell, Seltzer, Park & Gibson

[57] ABSTRACT

An apparatus and method for rotary forging a workpiece is disclosed which includes a manipulator for grasping and advancing the workpiece axially along a predetermined path of travel through a rotary forge mounted adjacent the manipulator. The rotary forge includes cooperating pairs of forging dies which work and reshape the workpiece. At least one induction heating coil located in-line with the path of travel of the workpiece through the forge is mounted adjacent the forge for selectively heating the workpiece as it is advanced into the rotary forge.

11 Claims, 2 Drawing Sheets

10
41
42
44
31
11
22
24
25
44
42
2
30
20
24 25
13
W
14
40
23
2
21

40
10

42
11
42
50
43
40
W
14
POWER SUPPLY

APPARATUS AND METHOD OF ROTARY FORGING WITH INDUCTION HEATING

FIELD OF THE INVENTION

This invention relates to an apparatus and method for hot working metals and alloys and more particularly to an apparatus and method of hot working metals and alloys within a rotary forge.

BACKGROUND OF THE INVENTION

Rotary forges are used to hot work large shapes such as wrought billets, powdered metal products and some tubular shapes. The workpiece is initially heated in a gas fired or electrically heated box furnace and is then transferred by an appropriate conveyance system to the rotary forge. During forging, the manipulator rotates and advances the preheated workpiece into the rotary forge where the forging dies shape and refine the workpiece. The dies of the rotary forge operate quite rapidly, and in many instances the dies actually place more energy into the workpiece than is lost through adiabatic cooling. Thus, the forging operation can be carried out over relatively long periods of time until the desired product refinement is accomplished.

However, certain alloys require a relatively narrow hot working temperature range. Consequently, during forging, periodic reheating of all or a portion of the workpiece may be necessary, especially where the workpiece is of considerable length. Reheating may also be needed in selected areas, such as at the ends where the workpiece is grasped by the manipulator.

Certain types of products can only be forged in a single pass through the rotary forge. For example, in consolidating a powdered metal product, specialized tapered dies are used in the forge which permit only a single pass through the forge. Similarly, in forming a seamless tubular product over a mandrel, the forging is restricted to a single pass through the rotary forge in these instances. The length of the workpiece is limited, since the trailing end of the workpiece must not have cooled below the minimum working temperature by the time it reaches the forging dies.

Some prior art forging systems such as disclosed in U.S. Pat. Nos. 4,362,578 and 4,407,486 to Mills, et al., disclose off-line supplemental heating using induction heating coils. However, off-line heating is not feasible with a rotary forge having single pass dies. The trailing end of a single pass workpiece must be reheated in-line within the rotary forge since a portion of the workpiece has passed through the forge making transfer of the workpiece to an off-line supplementary heating system impossible.

It is therefore an object of the present invention to provide a rotary forging apparatus and method which can reheat and refine the grain structure of a workpiece inline with the path of travel of the workpiece through the forge.

It is a further object of this invention to provide a rotary forge where both forging and reheating of a workpiece can be accomplished simultaneously on different areas of the workpiece as it moves through the rotary forge.

It is another object of the present invention to provide a rotary forge having a suitable induction heating coil which selectively moves from an operative position surrounding the path of travel of the workpiece as it enters the rotary forge to an inoperative position away from the path of travel of the workpiece into the forge.

SUMMARY OF THE INVENTION

These and other objects and advantages of the present invention are accomplished by an apparatus and method of rotary forging with induction heating wherein a first manipulator grasps a heated workpiece and advances the workpiece axially along a predetermined path of travel. A rotary forge is mounted adjacent to the manipulator and receives the workpiece therethrough. A second manipulator is mounted on the opposite side of the forge and grasps the workpiece as it leaves the forge. Another apparatus moves the first and second manipulators in a reciprocating path along the longitudinal axis of the workpiece to reciprocate the workpiece through the rotary forge.

The rotary forge includes a plurality of cooperating pairs of forging dies which move in a rapidly reciprocating motion into contact with the workpiece for working and reshaping the workpiece. During hot working the forge ordinarily puts work into the workpiece at a rate which equals or exceeds adiabatic cooling losses from the workpiece. An induction heating coil surrounds the path of travel of the workpiece as it enters the forge and selectively heats the workpiece as it is advanced into the rotary forge. An electric power supply operatively connects to the induction heating coil to supply power to the coil.

In the preferred embodiment, the induction heating coil comprises a coil of an open, generally C-shaped cross-sectional configuration. A mounting device mounts the coil for selective movement from an operative position surrounding the path of travel of the workpiece as it enters the rotary forge to an inoperative position away from the path of travel. To provide full reheating of the workpiece as it reciprocates back and forth through the forge, an induction heating coil is located closely adjacent each side of the rotary forge. The energizing of the coils is controlled in timed relation with the reciprocation of the workpiece through the forge. Depending on workpiece heating requirements, both coils located on either side of the rotary forge may be energized or only the coil located on the side where the reciprocating workpiece enters the forge is energized and operative.

In another embodiment of the invention, the cooperating pairs of forging dies are tapered single pass dies for reducing and compacting a powdered metal workpiece. A further embodiment includes a fixed mandrel mounted in coaxial alignment with the path of travel of the workpiece and in cooperating relationship with each forging die for forming the workpiece into a seamless tube as the workpiece is drawn over the mandrel and is hot worked by the rapidly moving dies.

BRIEF DESCRIPTION OF THE DRAWINGS

Some of the objects and advantages of the present invention having been stated, others will be more fully understood from the detailed description which follows and by reference to the accompanying drawings in which.

DETAILED DESCRIPTION

Figure 1:
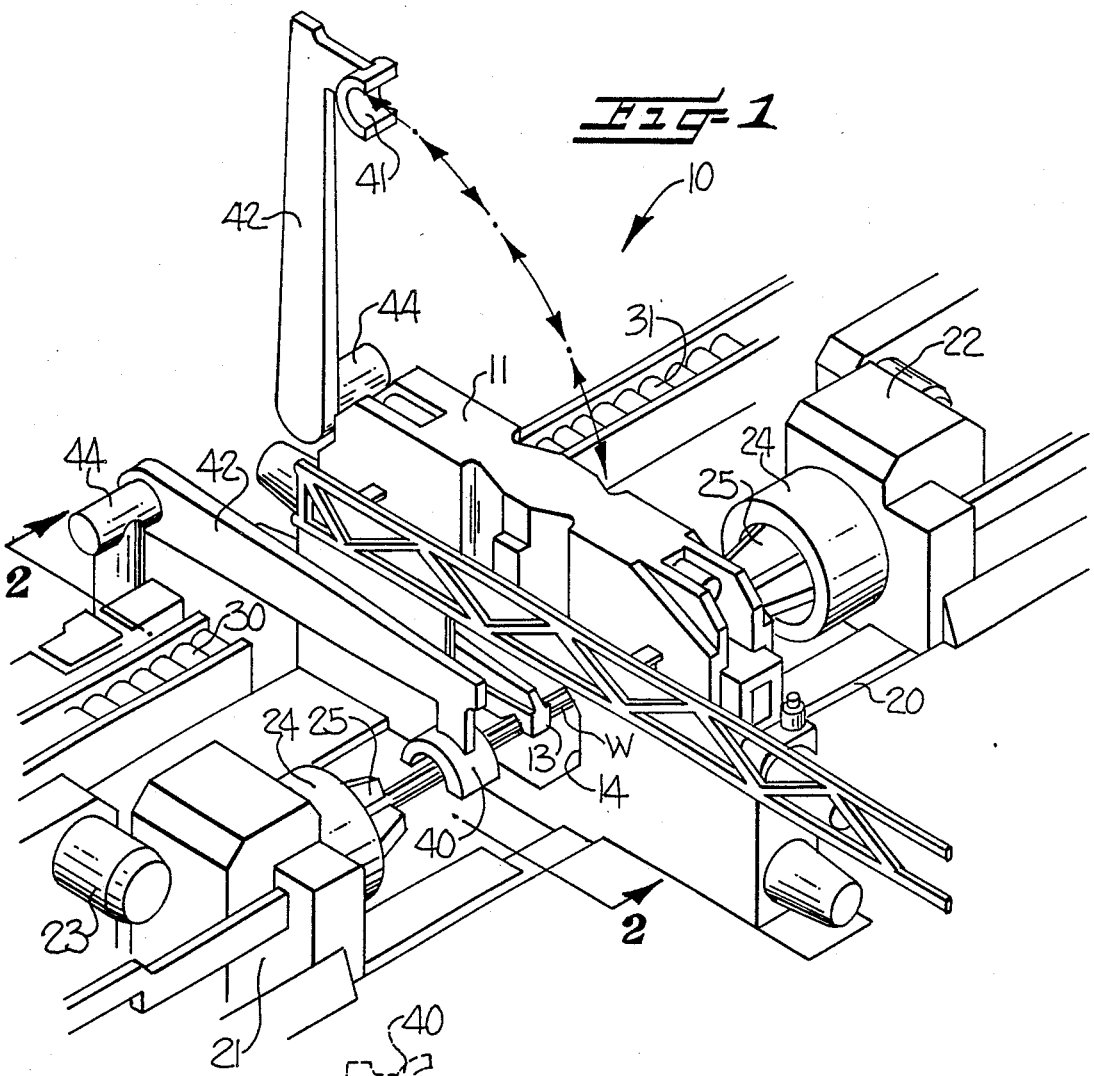
FIG. 1 is a perspective view of a rotary forge equipped with selectively movable induction heating coils in accordance with the invention.
Figure 2:
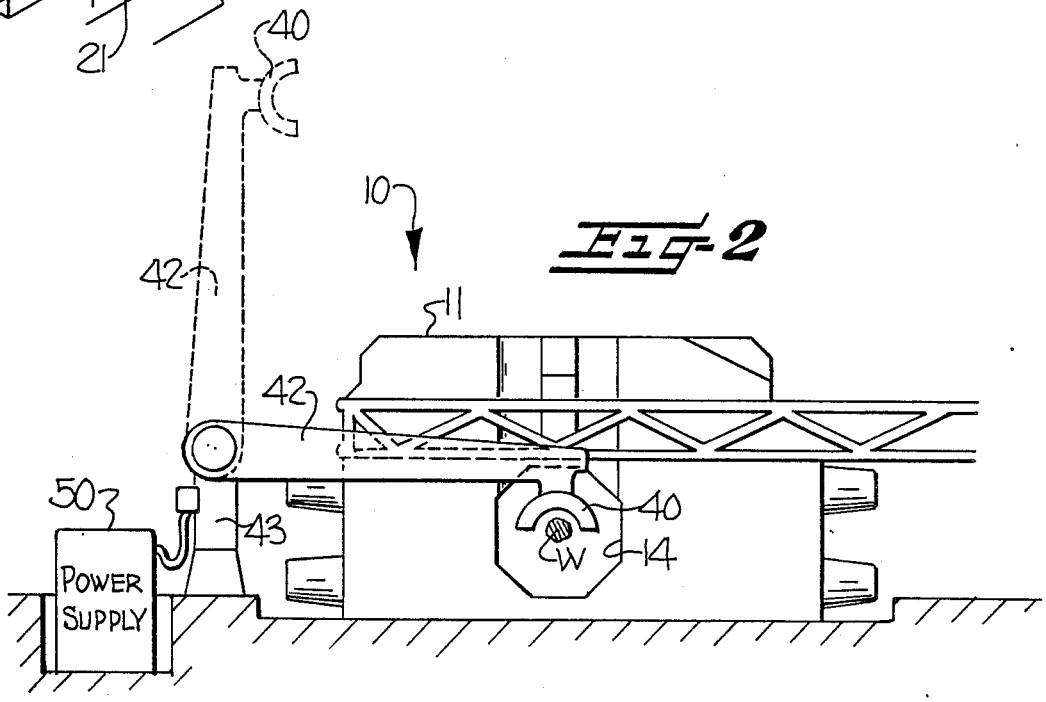
FIG. 2 is a sectional view taken along line 2—2 of FIG. 1.

Referring more particularly to the drawings and FIGS. 1 and 2, a rotary forge 10 is shown positioned on a work floor. As is standard with most rotary forges 10, the forge 10 includes a housing 11 containing two cooperating pairs of forging dies 12*a*, 12*b* (FIGS. 3–5) positioned within the housing 11 at a ninety degree offset from each other. As is conventional, a gearing mechanism and mechanical drive (not shown) are provided for moving each pair of forging dies 12*a*, 12*b* in a rapidly reciprocating motion into contact with a workpiece W to work and reshape the workpiece W. Attached to both sides of the housing 11 is a positioning bar 13 which initially guides the workpiece W into a housing opening 14 towards the forging space (not shown) where the forging dies 12*a*, 12*b* are located. During the actual forging operation, the positioning bar 13 acts as a restraint to prevent excessive motion of a workpiece W resulting from the pairs of forging dies 12*a*, 12*b* repeatedly contacting the workpiece W.

A carriage 20 traverses the longitudinal axis of the forge 10 and includes a first and second manipulator 21, 22 carried thereby on opposite sides of the rotary forge 10 to grasp a workpiece W at its opposite ends. As is conventional, a motor and drive means 23 interconnect both manipulators 21, 22 to provide the power to rotate the workpiece W and allow the manipulators 21, 22 to move the workpiece W in a reciprocating path through the forge 10 along the longitudinal axis of the workpiece W. Each manipulator 21, 22 includes a collet 24 having a four jaw assembly 25 which enables the manipulators 21, 22 to grasp a variety of geometrical workpiece shapes. Two support tables 30, 31 are located on opposite sides of the forge 10 to provide workpiece conveyance to and from the forge 10. The tables 30, 31 support a workpiece W and advance it to a secondary processing area for finishing or reheating. A conventional transfer system (not shown) acts to convey a workpiece W from the manipulators 21, 22 to the support tables 30, 31.

Located closely adjacent the sides of the forge 10 are two induction heating coils 40, 41 which are used to selectively heat the workpiece W as it is advanced into the rotary forge 10. Each induction heating coil 40, 41 has its heating coil wound so as to configure an open, generally C-shaped cross-section. In the preferred embodiment, each heating coil 40, 41 is mounted on a longitudinal arm 42 which can pivot about a base support 43 through the action of a direct drive motor 44. The arm arrangement is advantageous over other positioning mechanisms since the design is simple and efficient. The arms 42 pivot and move the heating coils 40, 41 from an operative position surrounding the path of travel of the workpiece W as it enters the rotary forge 10 to an inoperative position away from the path of travel of the workpiece into the forge 10. An electric power supply 50 (FIG. 2) operatively connects each heating coil 40, 41 to provide the power necessary to heat a metallic workpiece W. Included with the electric power supply 50 is a timing mechanism to control the operation of the heating coils 40, 41 in timed relation with the reciprocation of the workpiece W through the forge 10 so that at any given time, only the heating coil located on the side where the reciprocating workpiece W enters the forge 10 is energized. Although the preferred embodiment shows a heating coil having a generally C-shaped cross-section, a circular coil also may be used as long as the circular coil is positioned to receive a workpiece W therethrough prior to the workpiece entering the rotary forge 10. This limitation effectively restricts the use of a circular coil since it cannot be lowered onto a workpiece W which already has entered the rotary forge 10. The preferred illustrated embodiment poses no such limitation.

In operation, a workpiece W is simultaneously reciprocated through the forge 10 while the forging dies 12*a*, 12*b* are rapidly reciprocated into contact with the workpiece W. After the first successive reciprocations, the workpiece W has elongated which in turn prolongs an already slow reciprocation time attendant to rotary forging. This causes faster cooling of the outside surface of the workpiece W. Conventional metallurgical sensors (not shown) determine when the workpiece surface temperature has dropped below a predetermined optimum hot working temperature. The sensors signal the power supply 50 and timing mechanism. As the workpiece W begins its next entry into the forge 10, the heating coil 40 located on the side where the workpiece W enters the forge 10 is energized. The heating coil 40 heats the workpiece surface to its predetermined temperature range to allow further forging. In addition, the timing mechanism can be bypassed and power applied directly to each heating coil based upon the sensed values of workpiece W surface temperature. Thus, only those portions of a workpiece W which need reheating or grain refinement would be heated thereat.

Other metallurgically advantageous uses of the present invention where in-line induction heating coils 40, 41 are energized to either reheat or refine the workpiece are apparent. For example, before a workpiece W first enters the forge 10, the induction heating coil 40 may reheat the surface layers of the workpiece W just prior to forging so as to replace the heat losses encountered during transport of the workpiece W from the heating furnace (not shown) to the forge 10. Also, the end of a workpiece W which had been chilled by conductive heat losses to the manipulators 21, 22 can be reheated before it enters the forge 10. Supplemental heat also can be added to a workpiece W which is being hot worked by reduction practices within the rotary forge 10 where multiple reductions are insufficient to generate enough adiabatic heat to offset the radiant and conventional heat losses encountered during multiple pass processing. Likewise, the entire length of various workpiece surface layers can be reheated and recrystallized without any appreciable grain growth just before or after passing through the forging housing 11 In addition, the surface temperature of a workpiece W may be superheated above its interior temperature just prior to its entry into the forge 10 to initiate hot work of the workpiece W before any appreciable grain coarsening can occur, or a final forged workpiece W can be reheated above the critical temperature immediately after completion of hotworking and just prior to heat conditioning to better control grain formation. Finally, supplemental heat may be added to a workpiece which is hotworked within the rotary forge 10 by reduction practices which require slow axial feed rates through dies limited to single pass processing such as powdered metal compacting or seamless tube formation.

Figure 3:
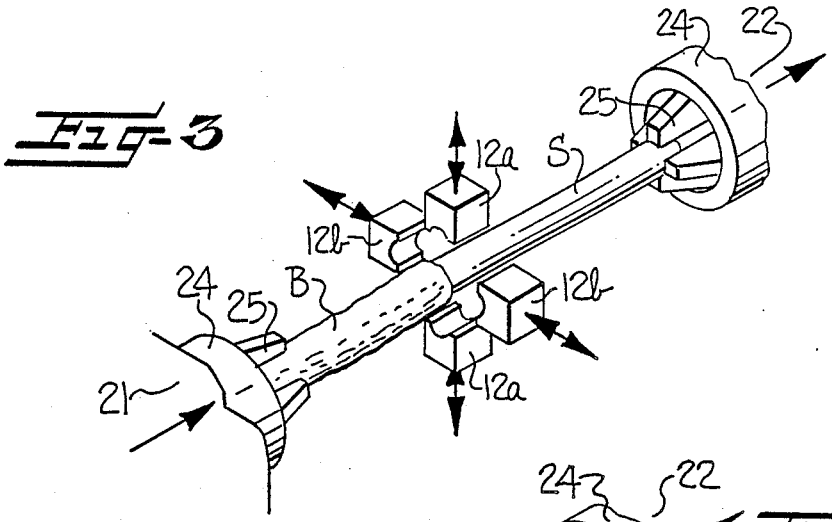
FIG. 3 is highly diagrammatic partial perspective view showing a workpiece held within manipulators as it is forged by the reciprocating dies of the rotary forge.
Figure 4:
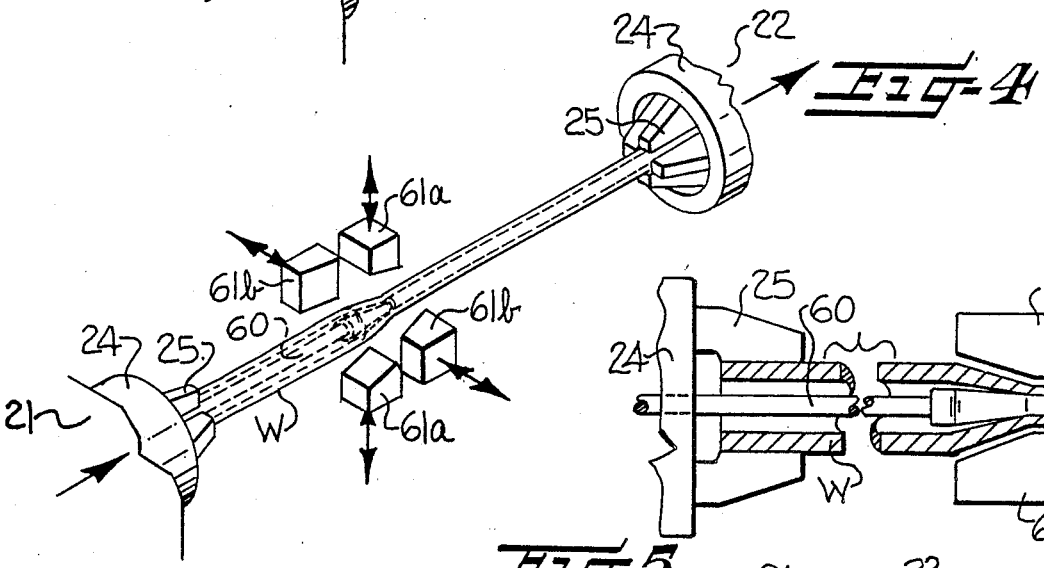
FIG. 4 is a highly diagrammatic partial perspective view of a hollow, cylindrical workpiece as it is forced over a fixed mandrel and forged into a seamless tube.
Figure 5:
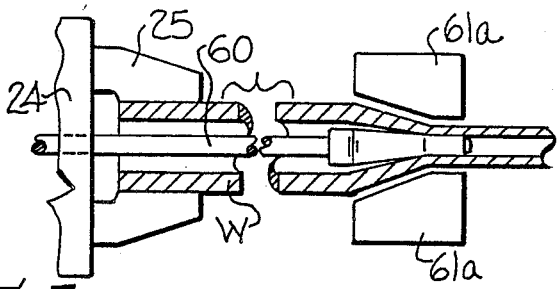
FIG. 5 is an enlarged sectional view of the mandrel, forging dies, and forged seamless tube of FIG. 4.

Referring now to FIGS. 3 to 5 there are seen three forging operations where the workpiece is hotworked within the rotary forge 10 by forging practices which require slow axial feed rates and in-line supplemental heating. In FIG. 3, a special alloy billet B having a slow axial feed rate is shaped into cylindrical stock S. As the billet B slowly advances through forging dies 12*a*, 12*b*, the unforged end of a billet B cools appreciably. When the billet B has cooled below an optimum hot working temperature range, the induction heating coil may be lowered to surround and reheat the billet B.

In FIGS. 4 and 5, a special alloy seamless tube T is formed from a hollow cylindrical workpiece W. A mandrel 60 is fixed within the forge 10 so as to extend through the first manipulator 21 in coaxial alignment with the workpiece W path of travel. Thus, the first manipulator 21 can be advanced relative to the fixed mandrel 60.

At the outset of forging, first and second manipulators 21, 22 hold a heated hollow cylindrical workpiece W within their respective collet 24 and jaw assembly 25 so that the mandrel 60 extends through the workpiece W. The second manipulator 22 is retracted to a position so that its collet 24 and jaw assembly 25 are adjacent the mandrel 60. Two cooperating pair of concave forging dies 61*a*, 61*b* guide the workpiece W over the mandrel 60 while simultaneously forging and reducing the workpiece W into a seamless tube T having an inside diameter substantially equal to the diameter of the mandrel 60 (FIG. 5). To progressively forge the tube T, respective first and second manipulators 21, 22 advance the workpiece W over the mandrel 60 while the dies 61*a*, 61*b* simultaneously forge the workpiece W into a seamless tube T. Since the in-line induction heating coil may be used to reheat the unforged portion of the workpiece W, long pieces of stock material may be used to produce seamless tubes T. When the seamless tube T is completed, the tube T is withdrawn from off the mandrel 60.

Figure 6:
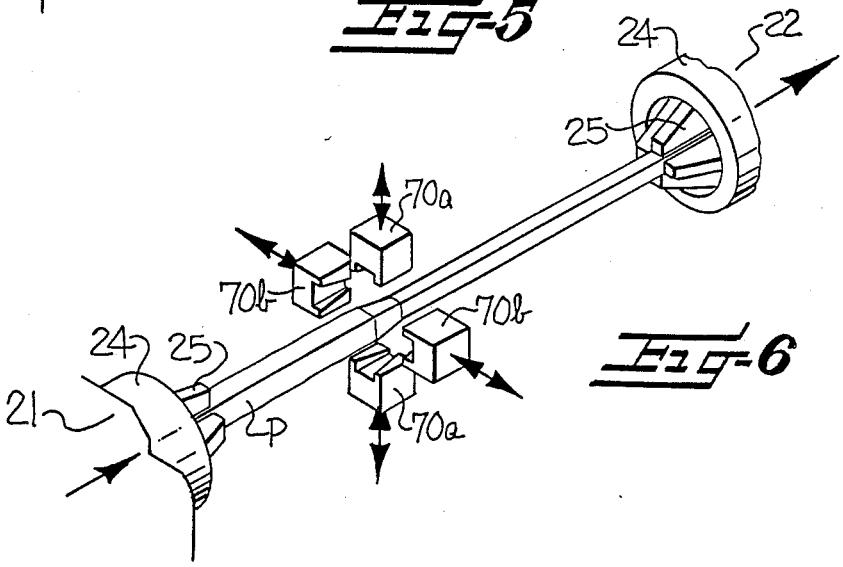
FIG. 6 is a highly diagrammatic perspective view of a powdered metal workpiece which is compressed by tapered forging dies.

In FIG. 6, an elongated powdered metal product P advancing at a slow axial feed rate through the forge 10 is sized nd compacted under high heat and pressure using two pairs of cooperating tapered forging dies 70*a*, 70*b*. The inline induction heating coil allows elongated powdered metal products to be compacted since those end portions which have cooled appreciably during the slower axial feed rate may be reheated.

While this invention has been described fully and completely with reference to certain specific illustrative embodiments as required by the patent laws, it must be understood that within the scope of the appended claims this invention may be practiced otherwise than as specifically described herein.

That which is claimed is:

1. Forging apparatus comprising manipulator means for grasping a heated workpiece and for advancing the workpiece axially along a predetermined path of travel, a rotary forge mounted adjacent to said manipulator means for receiving the heated workpiece therethrough, said rotary forge including a plurality of cooperating pairs of forging dies and means for moving each pair of forging dies in a rapidly reciprocating motion into contact with the workpiece for working and reshaping the workpiece, wherein the rotary forge ordinarily puts work into the workpiece at a rate which equals or exceeds adiabatic cooling losses from the workpiece, and induction heating means for selectively heating the workpiece as it is advanced into said rotary forge, and including electric power supply means and induction heating coil means operatively connected to said power supply means and positioned surrounding the path of travel of the workpiece as it enters the forge said induction heating coil means comprising a coil of generally C-shaped cross-sectional configuration, mounting means mounting said coil, said mounting means including a support base and longitudinal arm pivotably attached to said support base, with said coil mounted to said arm so that said coil can be selectively, pivotably moved from an operative position where the coil surrounds the path of travel of the workpiece as it enters the rotary forge to an inoperative position away from the path of travel of the workpiece into the forge, whereby the workpiece can be selectively heated, when needed, as it enters the forge to compensate for cooling losses.

2. Forging apparatus according to claim 1 wherein said manipulator means includes first and second manipulators mounted on opposite sides of said rotary forge for grasping the workpiece at its opposite ends, and means for moving said first and second manipulators in a reciprocating path along the longitudinal axis of said workpiece for thereby reciprocating the workpiece back and forth through said rotary forge, and wherein said induction heating coil means includes an induction heating coil located closely adjacent each side of the rotary forge.

3. Forging apparatus according to claim 2 also including means cooperating with said electric power supply means for controlling the application of power to said coils in timed relation with the reciprocation of the workpiece through the forge so that at any given time, only the coil located on the side where the reciprocating workpiece enters the forge is energized.

4. An apparatus according to claim 1 wherein said plurality of cooperating pairs of forging dies comprise tapered single pass dies for reducing and compacting a powdered metal workpiece.

5. An apparatus according to claim 1 including a fixed mandrel mounted in coaxial alignment with the path of travel of the workpiece and in cooperating relationship with each forging die for forming the workpiece into a seamless tube as the workpiece is drawn over the mandrel and is hot worked by the rapidly moving dies.

6. Forging apparatus comprising a rotary forge having cooperating pairs of forging dies and means for moving the forging dies in a rapidly reciprocating motion into contact with a workpiece to forge and reshape the workpiece, wherein the forge ordinarily puts work into the workpiece at a rate which equals or exceeds adiabatic cooling losses from the workpiece, first and second manipulators mounted on opposite sides of said rotary forge for grasping the workpiece at its opposite ends, means for moving said first and second manipulators in a reciprocating path along the longitudinal axis of said workpiece for thereby reciprocating the workpiece back and forth through said rotary forge, and for also rotating the workpiece on its axis as it is moved longitudinally through the rotary forge, induction heating means for selectively adding heat to the workpiece as it is advanced into said rotary forge, and including an induction heating coil of an open, generally C-shaped cross-sectional configuration located closely adjacent each side of the rotary forge and surrounding the path of travel of the workpiece as it enters and leaves the rotary forge, means for selectively applying electrical power to said coils and means cooperating with said electric power means for controlling the application of power to said coils in timed relation with the reciprocation of the workpiece through the forge so that only the coil located on the side where the workpiece enters the forge is energized to thereby add heat to the workpiece as it enters the forge, and mounting means mounting each of said coils for selective movement from an operative position surrounding the path of travel of the workpiece to an inoperative position away from the path of travel of the workpiece.

7. An apparatus according to claim 6 wherein said cooperating pairs of forging dies comprise tapered single pass dies for reducing and compacting a powdered metal workpiece.

8. An apparatus according to claim 6 including a fixed mandrel mounted in coaxial alignment within the path of travel of the workpiece and in cooperating relationship with each forging die for forming the workpiece into a seamless tube as the workpiece is drawn over the mandrel and is hot worked by the rapidly moving dies.

9. A method of forging comprising the steps of preheating a workpiece to a predetermined temperature within a predetermined optimum hot temperature range, advancing the preheated workpiece axially along a predetermined path of travel through a hot working rotary forge having cooperating pairs of forging dies while rapidly moving the forging dies into contact with the workpiece so as to forge and shape the workpiece, wherein the rotary forge ordinarily puts work into the workpiece at a rate which equals or exceeds adiabatic cooling losses from the workpiece, and selectively heating the workpiece just prior to its entering the forge by passing the workpiece through an induction heating coil located adjacent to the hot working rotary forge and selectively applying electrical power to the coil so as to energize the coil to selectively add heat to the workpiece and compensate for cooling of the workpiece which has occurred as the workpiece has advanced along its path of travel, and reciprocating the workpiece back and forth through the hot working rotary forge and inductively heating the workpiece just prior to its entering the forge in the reverse direction of reciprocating movement through the forge by passing the workpiece through another induction heating coil located adjacent the other side of the forge.

10. The method as claimed in claim 9 including the step of moving the heating coil from an operative position surrounding the path of travel of the workpiece to an inoperative position away from the path of travel.

11. A method of forging comprising the steps of preheating a workpiece to a predetermined temperature within a predetermined optimum hot working temperature range, moving the workpiece in a reciprocating path axially along a predetermined path of travel through a rotary forge having cooperating pairs of forging dies, while rapidly moving the forging dies into contact with the workpiece so as to forge and reshape the workpiece, passing the workpiece axially through a pair of electric induction heating coils which are positioned adjacent each side of the rotary forge and which surround the path of travel of the workpiece, and selectively applying electrical power to the induction heating coils in timed relation with the reciprocation of the workpiece through the rotary forge so that only the coil located on the side wherein the workpiece enters the forge is energized to thereby add heat to the workpiece as it enters the forge.

* * * * *